US006092580A

United States Patent [19]

Lucas

[11] Patent Number: 6,092,580

[45] Date of Patent: Jul. 25, 2000

[54] GARAGE CHILD/PET/VENTILATION GATE

[76] Inventor: Paul K Lucas, 5990 Lakeway Dr., Fayetteville, N.C. 28304

[21] Appl. No.: 09/326,320

[22] Filed: Jun. 7, 1999

[51] Int. Cl.[7] ..... E06B 3/48; E06B 3/32

[52] U.S. Cl. ..... 160/113; 160/97; 160/201

[58] Field of Search ..... 160/113, 116, 160/117, 118, 179, 201, 205, 368.1, 97; 24/306, 442

[56] References Cited

U.S. PATENT DOCUMENTS

| | | | |
|---|---|---|---|
| 4,231,412 | 11/1980 | Nowak . | |
| 4,378,043 | 3/1983 | Sorenson | 160/201 X |
| 4,426,816 | 1/1984 | Dean et al. | 160/368.1 X |
| 4,574,860 | 3/1986 | Weiss . | |
| 4,653,566 | 3/1987 | Miale . | |
| 4,673,019 | 6/1987 | Silverthorne . | |
| 5,050,660 | 9/1991 | Bleichwehl et al. | 160/113 |
| 5,097,886 | 3/1992 | Moyet-Ortiz | 160/368.1 |
| 5,136,759 | 8/1992 | Armour, II | 24/442 |
| 5,358,025 | 10/1994 | Wood | 160/368.1 |
| 5,408,789 | 4/1995 | Plfeger | 160/113 X |
| 5,427,169 | 6/1995 | Saulters | 160/368.1 |
| 5,603,591 | 2/1997 | McLellan | 24/442 X |
| 5,611,382 | 3/1997 | Sferra | 160/113 |
| 5,904,199 | 5/1999 | Messner | 160/201 X |

*Primary Examiner*—Daniel P. Stodola
*Assistant Examiner*—Hugh B. Thompson
*Attorney, Agent, or Firm*—Michael I. Kroll

[57] ABSTRACT

An auxiliary screened gate which is approximately the same size as a door panel in a garage door for attachment to the lower edge of the garage door. The auxiliary screened gate will allow light and air to pass therethrough. The upper edge of the screened gate is attached to the lower edge of the garage door. Hinges are employed to attach the screened gate to the garage door. A hook and eye latch is provided for securing the screened gate in its non-operative folded position on the lower interior of the garage door. A hinged mechanism is used to allow the screened door to be pivotally operated on the lower edge of the garage door.

3 Claims, 12 Drawing Sheets

GARAGE CHILD/PET/VENTILATION GATE

BACKGROUND OF THE INVENTION

1. Field of the Invention

The present invention relates generally to garage door screens and, more specifically, to a pivotal screen gate conforming substantially to the height of a garage door panel being hingedly connected to the base of the garage door and having securement means for holding said screened gate in a non-operative position against the inside of the garage door whereby said pivotal screen gate does not interfere with the normal operation of the garage door. Said securement means being hook and eye, bolt and clasp or hook and loop material adhesively attached to the mating oppositely opposed surfaces of the screen gate frame and the garage door.

Further, when said screen gate is releasably pivoted to an operative position the screen gate can be detached from the garage door by removing the hinge pins holding the screen gate to the garage door and disengaging the hook and loop straps from an at rest position on the back side of the garage door and passing said straps around the garage door track, securing them to the front of the garage door.

2. Description of the Prior Art

There are other screening devices designed for use with a garage door. Typical of these is U.S. Pat. No. 4,653,566 issued to Michael R. Mials on Mar. 31, 1987.

Another patent was issued to Silverthorne et al. on Jun. 16, 1987 as U.S. Pat. No. 4,673,019. Yet another U.S. Pat. No. 4,231,412 was issued to Nowak on Nov. 4, 1980 and still yet another was issued on Mar. 11, 1986 to Weiss as U.S. Pat. No. 4,574,860.

A garage door screen system is provided for a sectional garage door of the type which opens to an overhead position while supported by rollers contained in channels. The screen system is for a partially opened garage door and, in the preferred embodiment, provides separate screens for the bottom opening and the opening at the top which occurs as the door panels pivot inwardly. The bottom screen is alternately a rigid panel which is supported by vertical guides to the lowest door panel, or a window shade draw down type. A latch holds the lower ridge screen so that it does not extend below the door panel. When the latch is released, the screen panel will descend. The latch can be re-engaged merely by lowering the door. Torsion springs in the roller mechanism, automatically retract the screen secured to it when the latch holding the screen in its extended position is released. The top screen is attached at its top end to an upper cylinder which is secure to the door frame by pipe clamps. A lower cylinder is attached to the bottom end of the screen keeping it extended across the opening. This screen can be raised by rolling it about the lower cylinder. Alternatively, this upper screen may be left in its extended position without interfering with the opening and closing of the garage door. End and top covers are provided for the lower screen panel resulting in a system which will keep insects, etc. out, while permitting circulation of air.

A roll up apparatus comprises a rod having one edge of a flexible screen thereto and means to rotatably mount the rod to a garage door frame. The screen is provided with means to releasably attach its sides edges to the side members of the garage door frame, and means to maintain its bottom edge in contact with the ground when the screen is in a lowered position.

A screen door construction for selective attachment to a garage for placement in a garage door opening including an upper screen panel, a lower screen panel hingedly secured to said upper screen panel, a hinge pivotally mounting the upper edge of the upper screen panel to the upper edge of a garage door opening, first adjuster members for permitting the adjustment of the upper and lower panels within the garage door opening so as to fit them properly to occupy the entire height of the door opening and to extend horizontally therein, second adjuster members for adjusting the width of the panels to fit properly within the width of the garage door opening, and attachment structure for selectively attaching and detaching the upper screen panel relative to the garage door opening.

An adjustable storm garage door having a pair of fordable doors open at the center with each pair adjustably mounted to a jamb of the garage in spaced relationship with an existing overhead garage door for providing an insulating space between the doors.

While these screening devices designed for use with a garage door may be suitable for the purposes for which they were designed, they would not be as suitable for the purposes of the present invention, as hereinafter described.

SUMMARY OF THE PRESENT INVENTION

A primary object of the present invention is to provide a screen gate having attachment means to a garage door for the purposes of using the garage as an enclosure for toddlers and pets.

Another object of the present invention is to provide a screen gate having attachment means to a garage door for the purposes of providing ventilation within said garage while keeping the garage door opening substantially closed;

Yet another object of the present invention is to provide a screen gate which is pivotally attached to the base of the garage door;

Still yet another object of the present invention is to provide a screen gate which is pivotally attached to the base of the garage door and having securement for holding said screen gate in a non-operative position against the inside of said garage door;

Another object of the present invention is to provide a screen gate which can be detached from the garage door and used as a stand alone screen barrier to prevent toddlers and pets from leaving the garage;

Yet another object of the present invention is to provide a screen gate which can be detached from the garage door and used as a stand alone screen door having extendable members located on the sides of said screen gate for engaging the jamb of the garage door;

Additional objects of the present invention will appear as the description proceeds.

The present invention overcomes the shortcomings of the prior art by providing a pivotal screen gate conforming substantially to the height of a garage door panel and being hingedly connected to the base of the garage door and having securement means for holding said screened gate in a non-operative position against the inside of the garage door whereby said pivotal screen gate does not interfere with the normal operation of the garage door. Additionally, the screen gate can be used as a stand alone gate by pivoting said screened gate to an operative position and removing the hinge pins holding the screen gate to the garage door and slidably extending the bolt members located on the periphery sides of the screen gate into the frame of the garage door opening.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

SUMMARY OF THE PRESENT INVENTION

Figure 1:
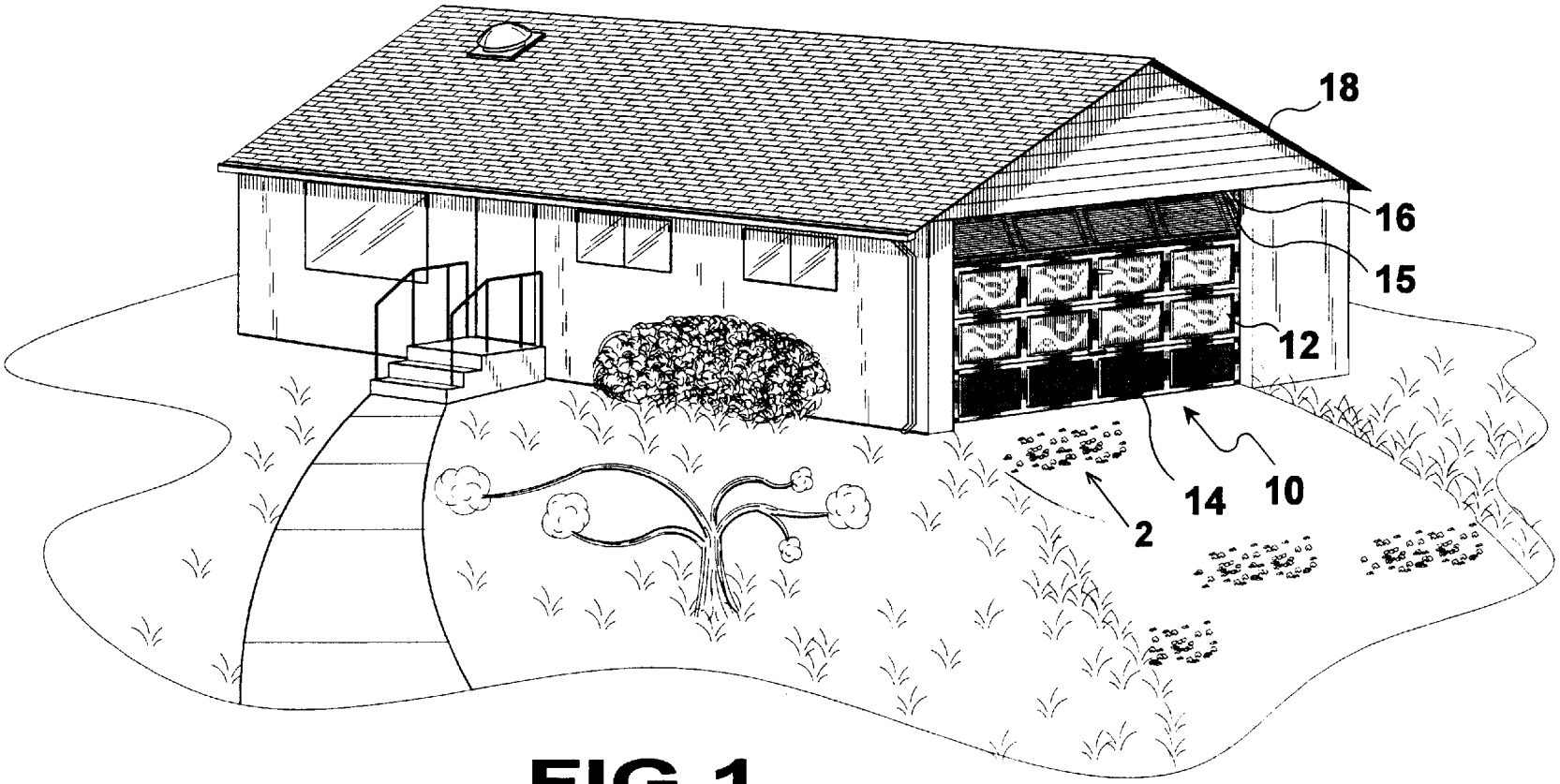
FIG. 1 is perspective view of a garage door having the present invention installed. Shown is a screened gate having been pivotally rotated to an operative position wherein the screen gate substantially conforms to the opening of the garage door frame therein providing means for using the garage as an enclosure for toddlers and pets while allowing light and air into the garage.

The present invention discloses an auxiliary screened gate being approximately the same size as a door panel of the garage door for attachment to the lower edge of a conventional garage door. The auxiliary gate is a screened gate which will allow light and air to pass therethrough. The upper edge of the screened gate is attached to the lower edge of the conventional garage door. Means for attaching the screened panel include hinging means. A hook and eye latch is provided for securing the screened gate in its non-operative folded position on the lower interior of the conventional garage door. A hinged mechanism is used to allow the screened door to be pivotally operated on the lower edge of the conventional garage door.

List of Reference Numerals

With regard to the reference numerals used, the following numbering is used throughout the drawings.

10 present invention
12 garage door
13 frame member
14 screened gate
15 garage door frame/track
16 garage opening
18 house
20 lower edge of garage door panel
21 upper edge of gate
22 garage door handle
24 garage door handle
26 securement members
30 hinge pins
32 hinge member
34 hook and eye latching means
36 securement means
38 garage door panel

40 upper edge of garage door panel
42 interior securement member
44 means for attachment
46 direction arrow Description of the Preferred Embodiment(s)

Turning now descriptively to the drawings, in which similar reference characters denote similar elements throughout the several views, FIGS. 1 through 12 illustrate the present invention being an auxiliary screen door for attachment to a conventional garage door.

Turning to FIG. 1, therein is shown a perspective view of a conventional, electrically or manually operating garage door 12 having the present invention 10 installed on its lower edge. Shown is a screened gate-like device 14 having been pivotally rotated to an operative down position wherein the screened gate 14 substantially conforms to the opening of the garage door frame 15 therein providing means for using the garage as an enclosure for toddlers and pets while allowing light and air into the garage door opening and enclosure 16. The garage 16 is shown connected to and constructed as part of the house 18.

Figure 2:
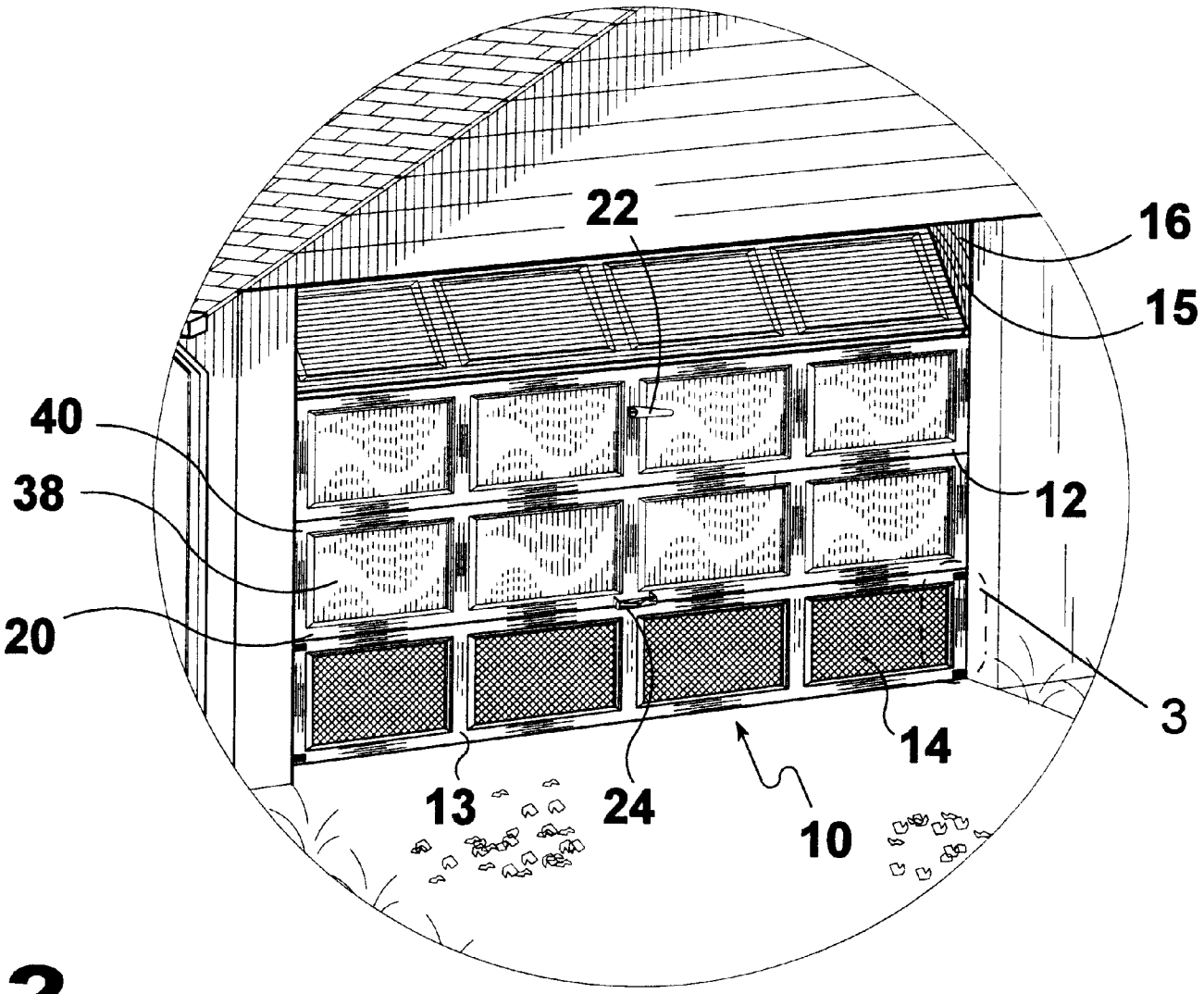
FIG. 2 is an enlarged view, taken from FIG. 1 as indicated, showing the present invention in an operative position at the base of an existing garage door thereby permitting light and air to enter the garage while keeping the garage door opening substantially closed.

Turning to FIG. 2, therein is shown an enlarged view taken from FIG. 1 as indicated, showing the present invention 10 in operative position attached to and positioned longitudinally along the base or lower edge 20 of an existing garage door 12 thereby permitting light and air to enter the garage 16 while keeping the garage door 12 opening substantially closed. Also shown is the screened gate portion 14 of the present invention 10 having a frame 13 member. Also shown are the garage door control or locking handle 22 and the lifting handle 24 along with the garage door frame or track 15. Note that the screened gate 14 is effectively the same size and shape as one panel 38 of the garage door 12 which panel is defined as extending vertically from its lower edge 20 to its upper edge 40 and extending horizontally across the width of the garage door 12 being effectively the same width. Several individual panels 38 are joined together in the standard manner to form the garage door 12.

Figure 3:
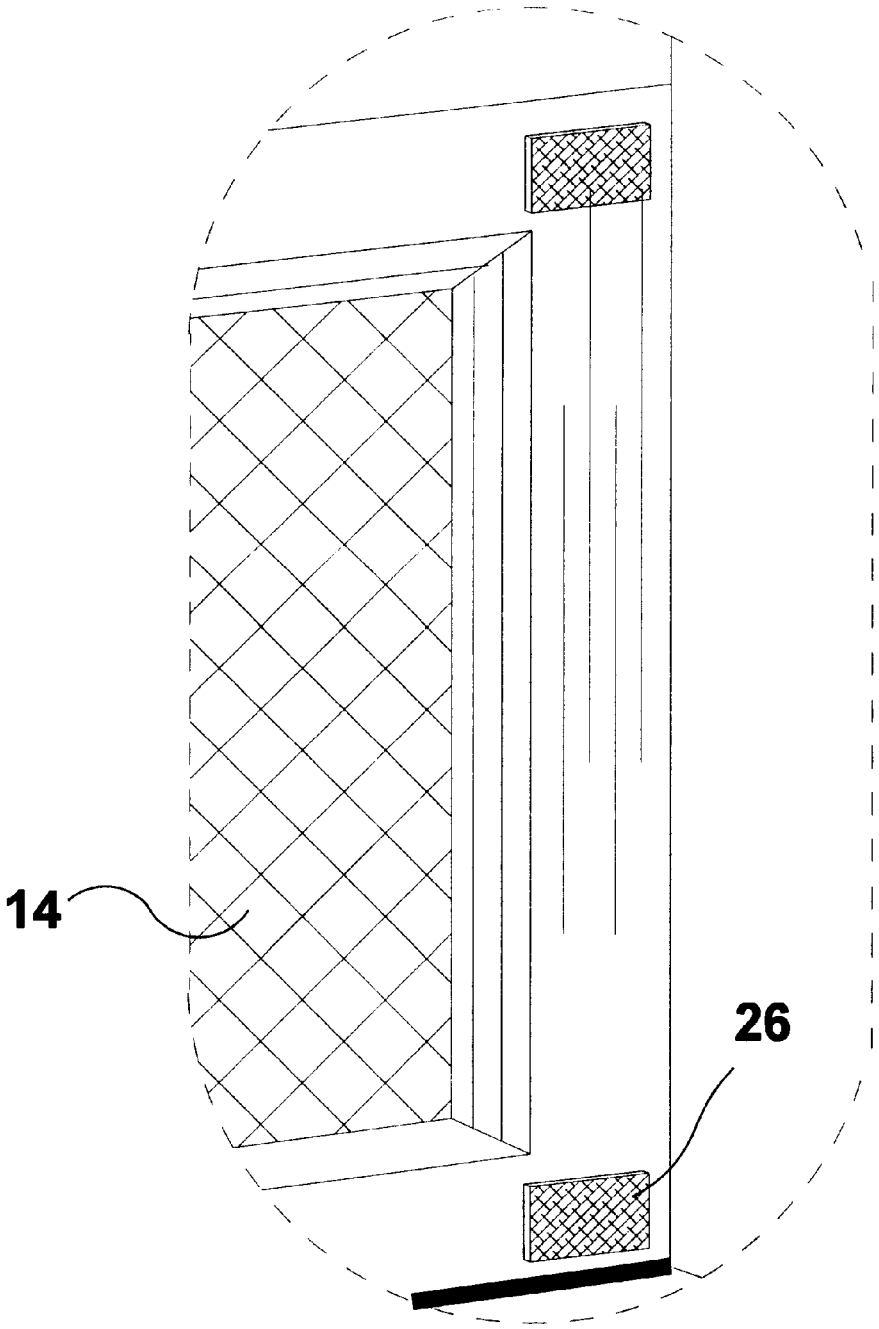
FIG. 3 is an enlarged view, taken from FIG. 2 as indicated, showing one of the screen gate securement members. The securement members are needed only when the gate is being used as a standalone barrier. Otherwise, the weight of the garage door will keep the screen gate securely in the operative position.

Turning to FIG. 3, therein is shown an enlarged view, taken from FIG. 2 as indicated, showing one of the screened gate securement members 26 attached to the front of the present invention 10. The securement members are needed only when the gate 14 is being used as a stand-alone barrier and will be further described hereinafter. Otherwise, the weight of the garage door 12 will keep the screened gate 14 securely in the operative position.

Figure 4:
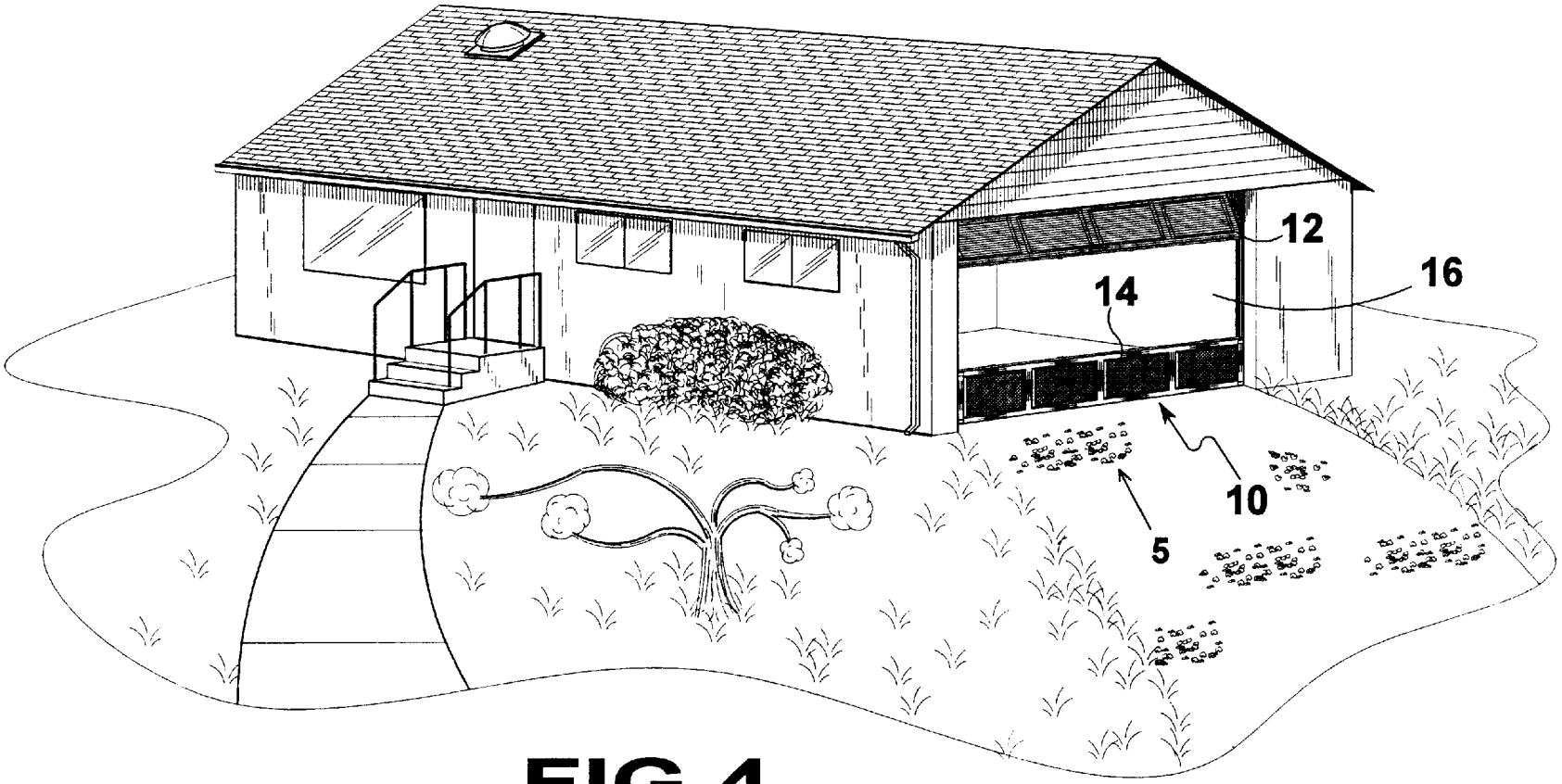
FIG. 4 is perspective view of a garage door in the fully open position. Shown is the screened gate having been pivotally rotated to an operative position and the hinge pins removed. Thereby providing means for keeping toddlers and pets inside the garage while allowing full view of the garage enclosure.

Turning to FIG. 4, therein is shown a perspective view of a garage door 12 in the fully open position. Shown is the screened gate 14 having been pivotally rotated to an operative stand-alone position and the hinged pins 30 (not shown) removed, thereby providing means for keeping toddlers and pets inside the garage 16 while allowing fill use of the garage enclosure.

Figure 5:
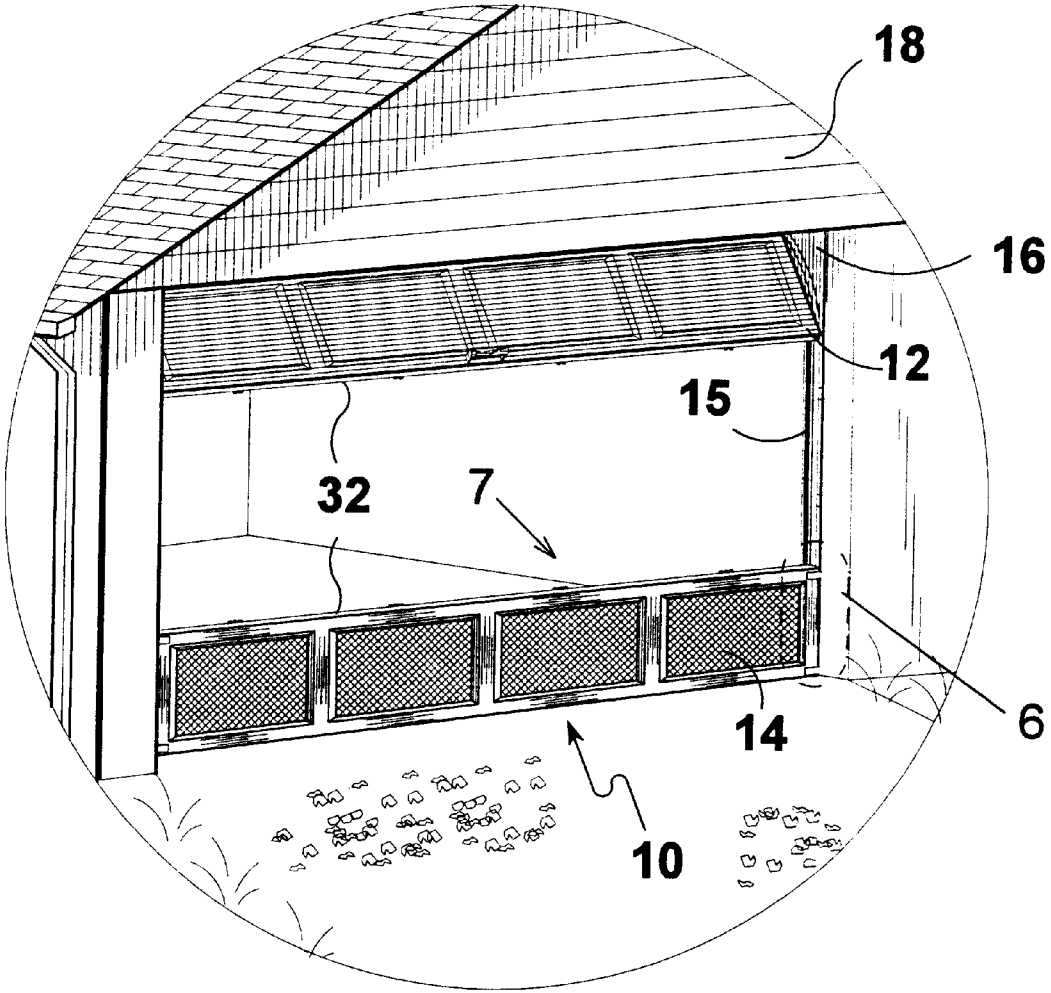
FIG. 5 is an enlarged view, taken from FIG. 4 as indicated, showing the screen gate being used as a standalone screen barrier wherein toddlers and pets can be kept from entering and/or leaving the garage enclosure.

Turning to FIG. 5, therein is shown an enlarged view, taken from FIG. 4 as indicated, showing the screened gate 14 being used as a stand-alone screen barrier wherein toddlers can be kept from entering or leaving the garage 16 enclosure. Also shown is the garage door 12 and house 18. Hinge members 32 are also shown along with the garage door frame or tracks 15.

Figure 6:
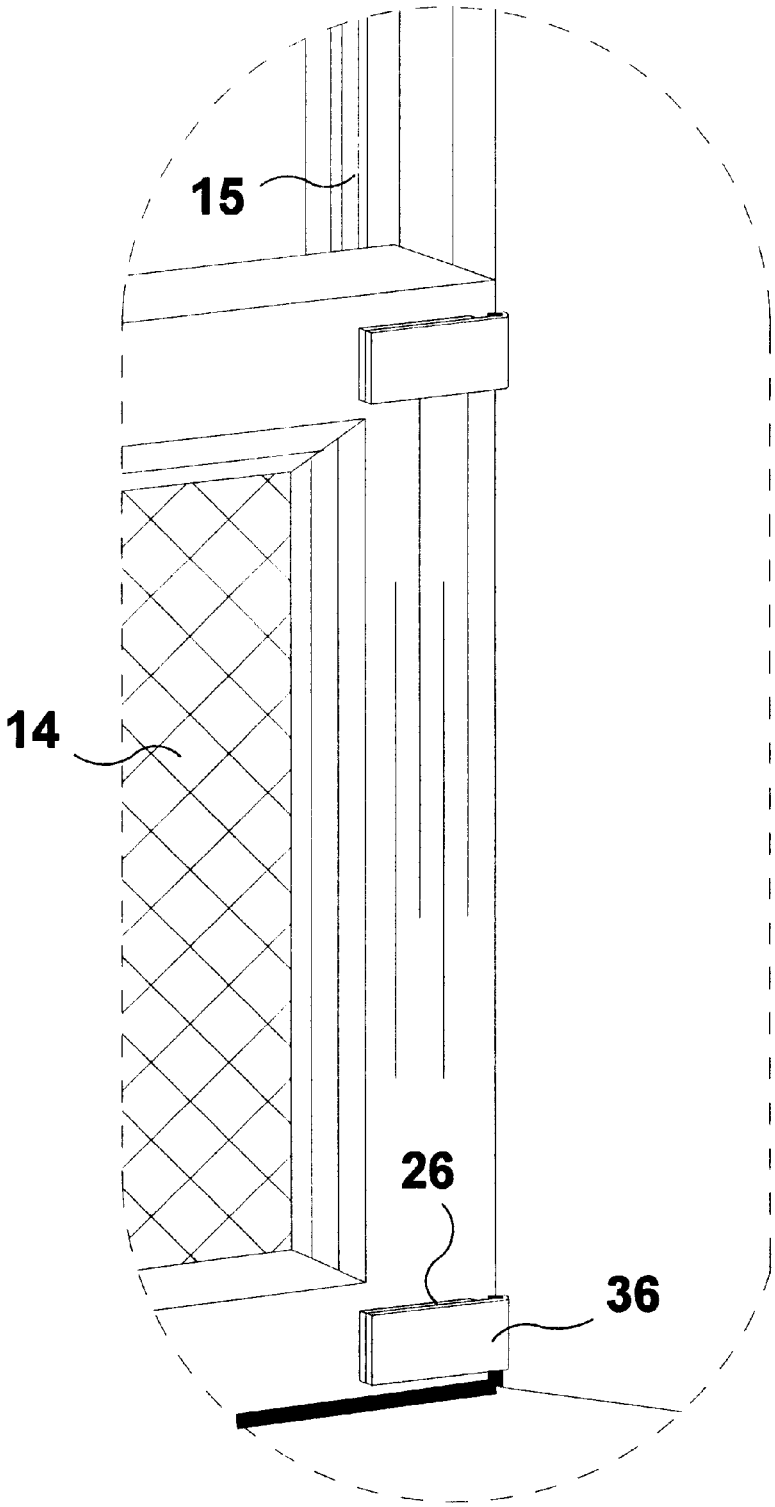
FIG. 6 is an enlarged view, taken from FIG. 5 as indicated, showing one side of the screen gate securement members in the engaged position therein providing support for the screen gate by engaging the tracks of the garage door.

Turning to FIG. 6, therein is shown an enlarged view, taken from FIG. 5 as indicated, showing one side of the screened gate securement members 26 having a mating securement member 36 attached to its face in the engaged position therein providing support for the screened gate 14 by engaging the tracks 15 of the garage door 16.

Figure 7:
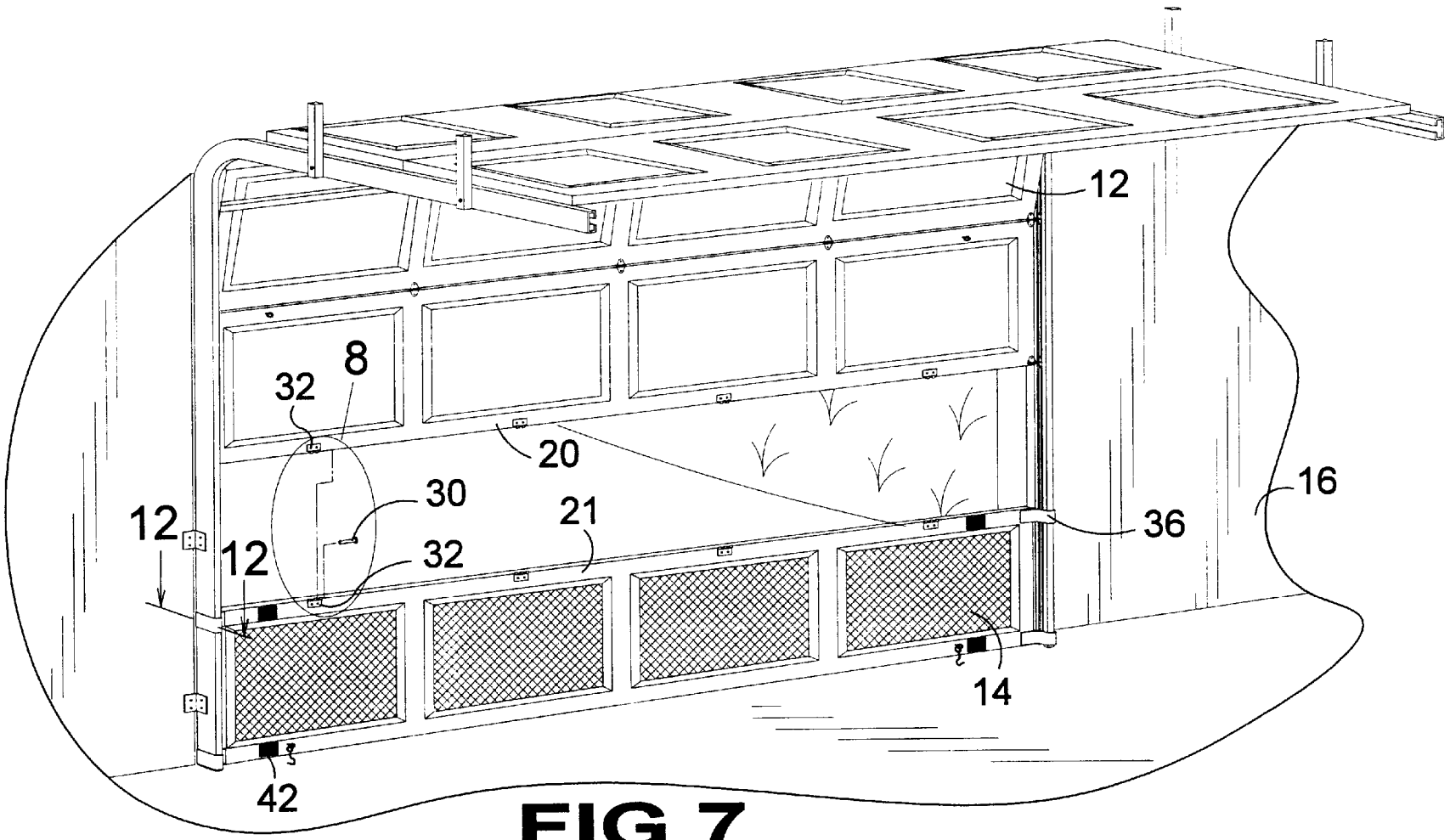
FIG. 7 is an interior view of the garage door and screened gate, taken from FIG. 5 as indicated. Shown is the screened gate in the operative position and having been detached from the garage door by removing the hinge pins wherein the garage door can be raised to an at rest position while the screened gate can be used as a barrier to keep toddlers and pets inside the garage enclosure or to keep them from entering into the garage enclosure. The screened gate can be easily attached to the garage door by lowering the garage door and reinserting the hinge pins.

Turning to FIG. 7, therein is shown an interior view of the garage door 12 and screened gate 14 taken from FIG. 5 as indicated. Shown is the screened gate 14 in the operative stand-alone position having been detached from the garage door 12 by removing the hinge pins 30 wherein the garage door 12 can be raised to an at-rest position while the screened gate 14 can be used as a stand-alone barrier to keep toddlers and pets inside the garage enclosure 16 or to keep them outside from entering into the garage enclosure. The screened gate 14 can be easily attached to the garage door 12 by lowering the garage door and reinserting the hinge pins 30 in the hinge members 32. The mating hinge pieces 32 for receiving the hinge pin 30 are also shown with one being attached to the lower edge 20 of the garage door 12 and one being attached to the upper edge 21 of the screened gate 14. A plurality of hinge pieces 32 are shown attached to the door 12 and gate 14. Securement means 36 is also shown.

Figure 8:
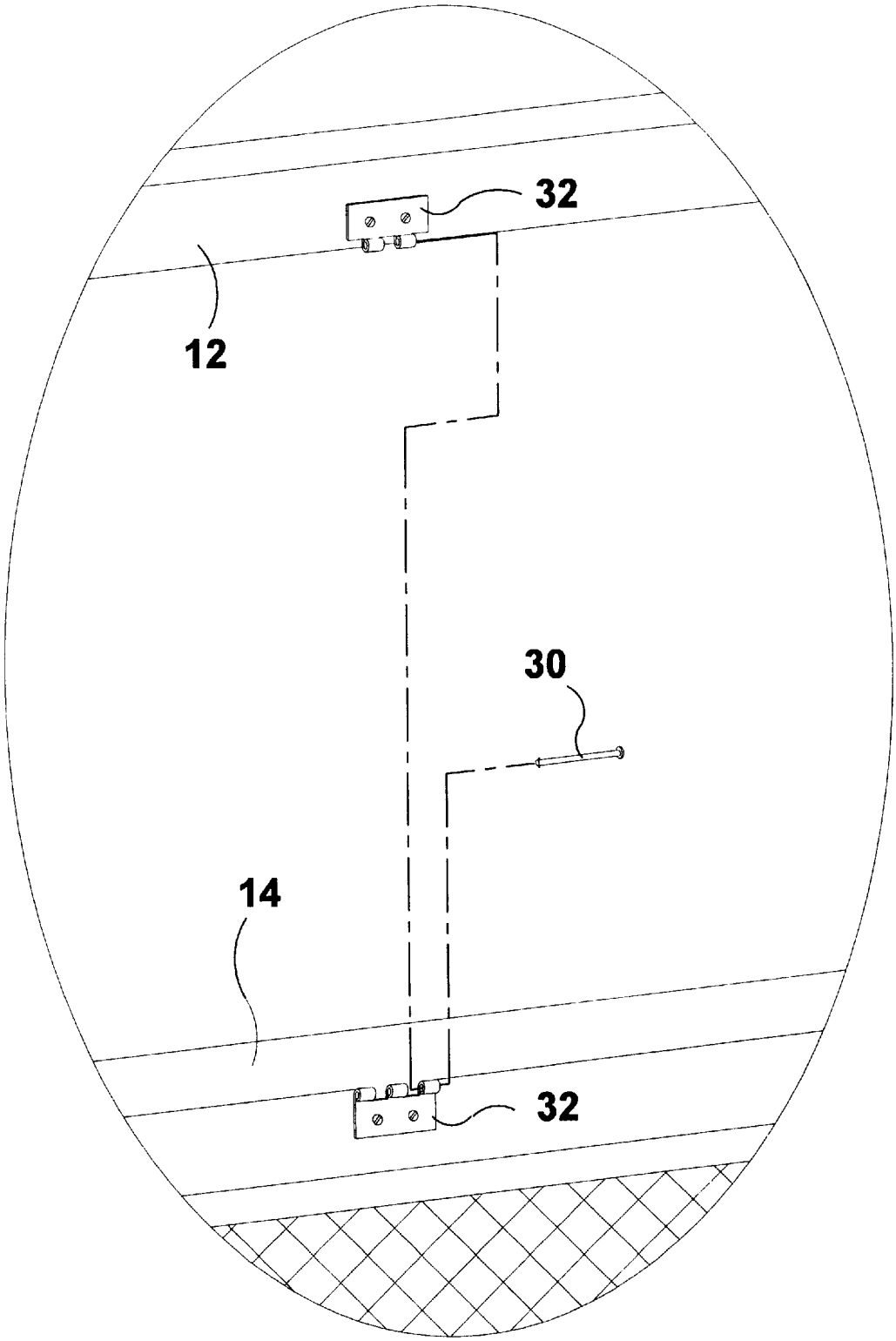
FIG. 8 is an enlarged view, taken from FIG. 7 as indicated, showing the means for selectively attaching the screen gate to the garage door by lowering the garage door until the garage door hinge member engages the screen gate hinge member wherein the hinge pin is inserted, or selectively releasing the screened gate from the garage door by removing the hinge pins.

Turning to FIG. 8, therein is shown an enlarged view, taken from FIG. 7 as indicated, showing the means for selectively attaching the screened gate 14 to the garage door 12 by lowering the garage door until the garage door hinge member 32 engages the mating screened gate hinge member 32 wherein the hinge pin 30 is inserted, or selectively releasing the screened gate 14 from the garage door 12 by moving the hinge pin 30.

Figure 9:
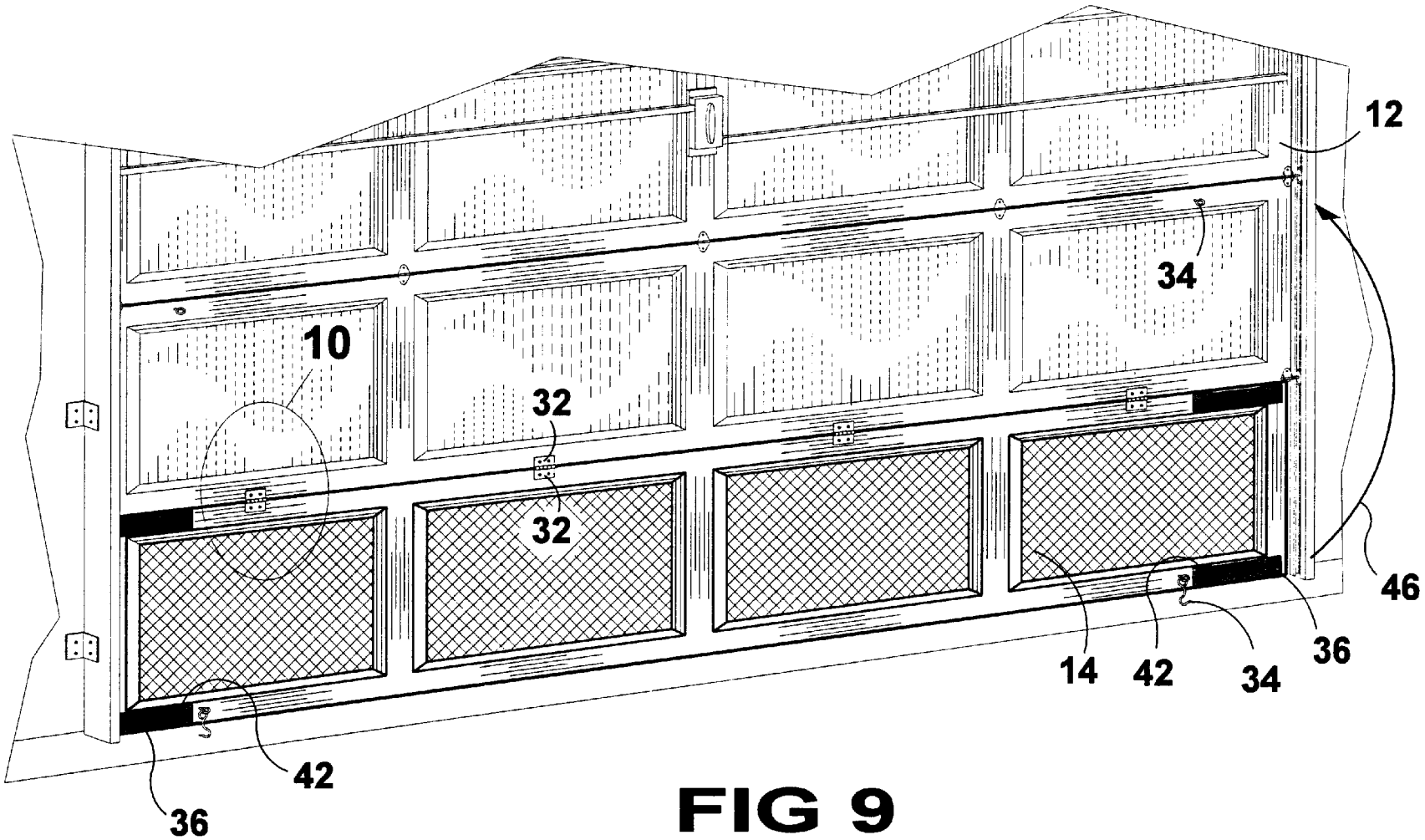
FIG. 9 is an interior view of the garage door opening having the garage door in the closed position having the screened gate pivotally extended to an operative position. Also shown for illustrative purposes is one means for securing the screen gate to the garage door using hook and eye latches.

Turning to FIG. 9, therein is shown an interior view of the garage door 12 opening having the garage door 12 in the closed position having the screened gate 14 pivotally extended on hinge members 32 to an operative position. Also shown for illustrative purposes is one means 34 for securing the screened gate 14 in the upwardly folded position to the garage door 12 using the hook and eye latches 34. Garage door tracks 15 are also shown. Hook and loop means 36 is also shown attached to means 42 and will be further described hereinafter. Direction arrow 46 also shows how gate 14 is folded upwardly onto the inside face of the lower panel of garage door 12 and secured thereto with means 34.

Figure 10:
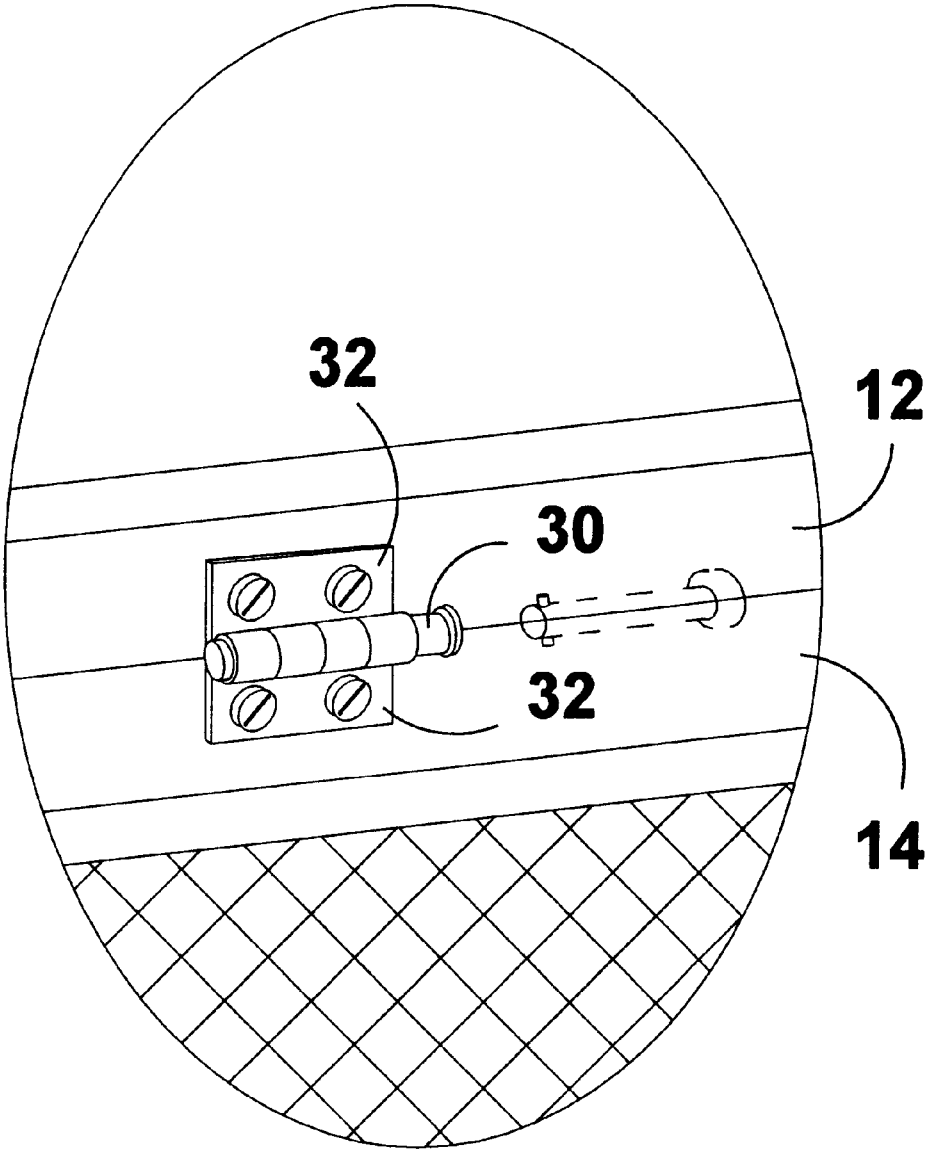
FIG. 10 is an enlarged view, taken from FIG. 9 as indicated, showing one of the hinges used to provide means for securing the screened gate to the garage door while the screen gate is in the operative position, as well as providing means for pivotally moving and storing the screen gate in a non-operate position.

Turning to FIG. 10, therein is shown an enlarged view, taken from FIG. 9 as indicated, showing one of the hinges 32 used to provide means for securing the screened gate 14 to the garage door 12 while the screened gate is in the operative position, as well as providing means for pivotally moving and storing the screened gate 14 in the non-operative folded position. Also shown is the hinge pin 30.

Figure 11:
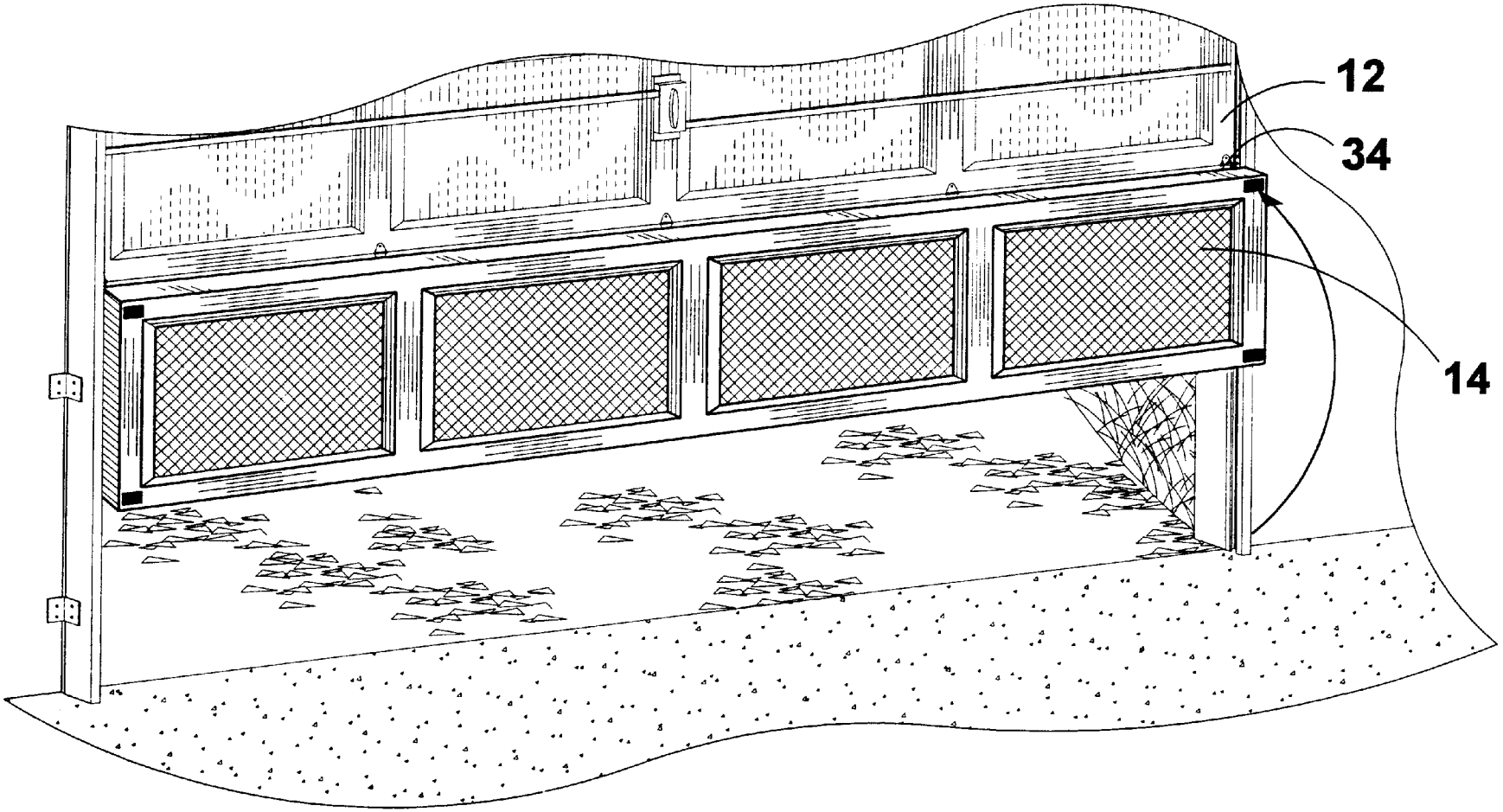
FIG. 11 is an interior view of the garage door opening wherein the screen gate has been pivotally rotated to a non-operative position and secured to the back of the garage door by eye and hook, or by any appropriate means such as, mating hook and loop material mounted between the mating surfaces of said screened gate and the back of the garage door or by any other suitable means.

Turning to FIG. 11, therein is shown an interior view of the garage door 12 and opening wherein the screened gate 14 has been pivotally rotated to a non-operative upwardly folded position on the inside of the garage door 12 and secured to the back of panel 38 (not visible) of the garage door 12 by means for securement, e.g., being hook and eye latches 34 or by any appropriate means such as, mating hook and loop material mounted between the mating surfaces of said screened gate 14 and back of the garage door 12 or by any other suitable means.

Figure 12:
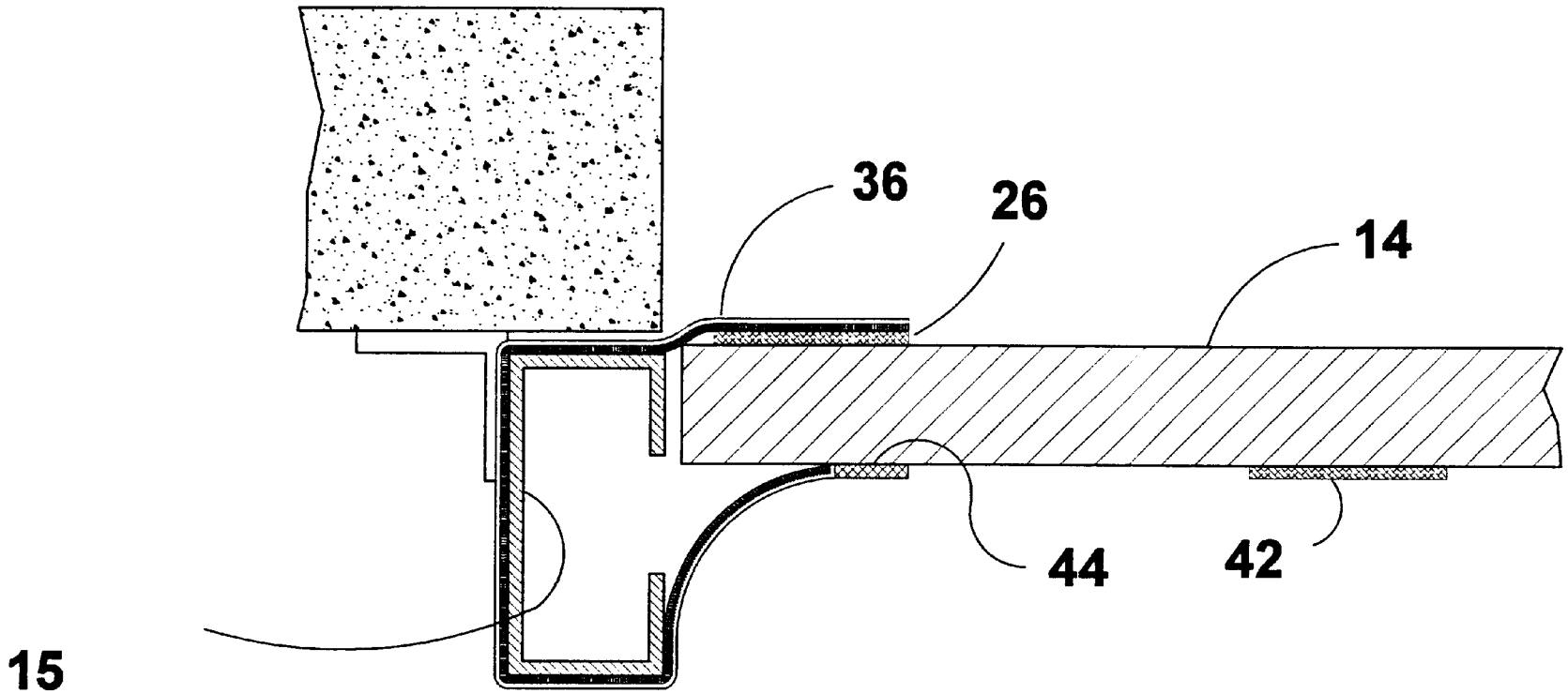
FIG. 12 is a sectional view of the present invention taken from FIG. 7 as indicated. Shown is a length of hook and loop material which is looped around the track of the garage door thereby securing said screen gate from movement. The hook and loop material will be stored in a non-operative position by attach the free end of the strap to an appropriately placed securing point being an amount of hook and loop material located on the interior surface of the garage door.

Turning to FIG. 12, therein is shown a sectional view of the present invention taken from FIG. 7, as indicated. Shown is securement means 36 being a length of hook and loop material attached to mating securement means or members 26 on the front of gate 14 which means 36 is looped around the track 15 of the garage door 12 thereby securing said screened gate 14 from movement. The hook and loop material 36 will be stored in a non-operative position by attaching the free end of the strap 36 to an appropriately placed securing point 42 being an amount of mating hook and loop material 42 located on the interior surface of the garage door 12. Also shown is the attachment means 44 for attaching member 36 to inside face of gate 14 which could be, e.g., glue or double faced tape.

What is claimed is:

1. An apparatus for attachment to, and in combination with a garage door movable along a track, comprising:

a) a frame member;

b) said frame member being rectangularly shaped;

c) said frame member being effectively the same size as a garage door panel;

d) said frame member being effectively the same width as said garage door;

e) said frame member having a screened portion;

f) means for attaching said frame member to the garage door whereby said frame member is secured to a lower edge of the garage door;

g) a first means for securing said frame member to a position on the inside of the garage door when said frame member is in a non-operative folded position;

h) said frame member being secured to the inside of the garage door when said frame member is in the non-operative folded position;

i) second means for securing said frame member to the garage door track when said frame member is in a stand-alone position unattached to said garage door; and j) said frame member having a strap of hook and loop material secured to an inner face of said frame member, said strap of hook and loop material encircling the garage door track and the end of said strap engaging a mating piece of hook and loop material on an outer face of said frame member.

2. The apparatus of claim 1, said mating piece of hook and loop material being attached to said frame member by glue.

3. The apparatus of claim 1, said mating piece of hook and loop material being attached to said frame member by double faced tape.

* * * * *